United States Patent [19]

Skaggs et al.

[11] 4,219,146

[45] Aug. 26, 1980

[54] PARTITION

[75] Inventors: Boyd T. Skaggs, Louisville; Doyle W. Patton, Crestwood, both of Ky.

[73] Assignee: Container Corporation of America, Chicago, Ill.

[21] Appl. No.: 90,901

[22] Filed: Nov. 5, 1979

[51] Int. Cl.[3] ..... B65D 5/48; B65D 25/04

[52] U.S. Cl. ..... 229/15

[58] Field of Search ..... 229/15, 42

[56] References Cited

U.S. PATENT DOCUMENTS

| | | | |
|---|---|---|---|
| 3,365,112 | 1/1968 | Priest et al. | 229/15 X |
| 3,380,642 | 4/1968 | Kotowick | 229/15 |
| 4,096,984 | 6/1978 | Gardner | 229/15 |

*Primary Examiner*—Davis T. Moorhead

*Attorney, Agent, or Firm*—Richard W. Carpenter

[57] ABSTRACT

An internal partition for dividing a container into a plurality of cells is formed from a pair of blanks of paperboard or the like. One of the blanks after erection is placed in inverted interlocking relationship with respect to a like erected blank to provide a plurality of central diamond-shaped cells flanked by peripheral cells in the form of half diamonds.

2 Claims, 4 Drawing Figures

PARTITION

SUMMARY OF THE INVENTION

The present invention relates generally to internal partitions made of unitary blanks of paperboard and arranged to provide a plurality of cells within a container. According to the invention a single blank is configured and arranged to form a partition element adapted to cooperate with a like and inverted partition element to provide greater cells from two blanks than has been know heretofore.

THE DRAWINGS

It will be understood that, for purposes of clarity, certain elements may have been intentionally omitted from certain views where they are believed to be illustrated to better advantage in other views.

THE DESCRIPTION

Figure 4:
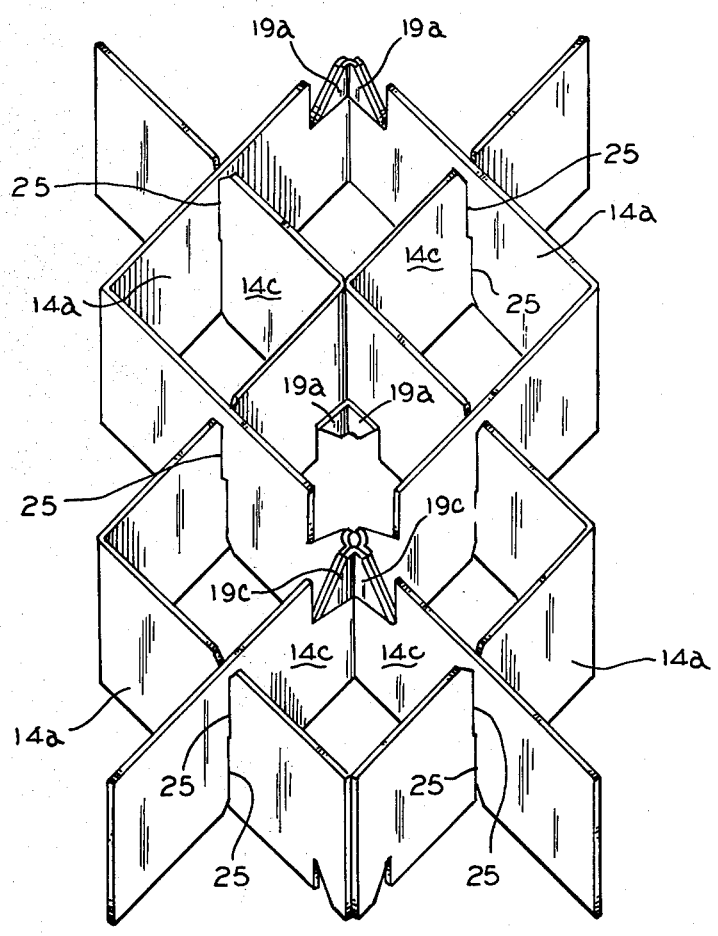
FIG. 4 is an isometric view showing the structures of FIGS. 2 and 3 assembled.

Referring now to the drawings for a better understanding of the invention, it will be seen that the novel partition, indicated generally at P in FIG. 4, is adapted to be received within an outer wrapping or container.

Partition P includes a pair of identical partition sections indicated generally at PS which are assembled in interlocking relationship as described later in the specification. Each of the partition sections may be formed from a unitary blank B of foldable paperboard as shown in FIG. 1.

Figure 1:
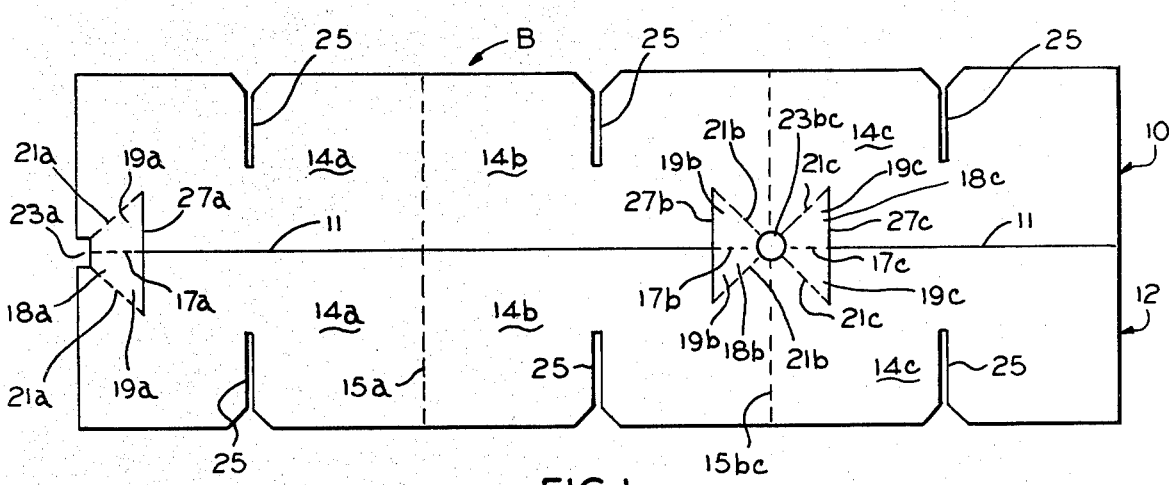
FIG. 1 is a plan view of a cut and scored blank of paperboard for forming a partition element according to the present invention.

As seen in FIG. 1, each of the partition sections includes a pair of generally similar first and second panels 10 and 12 which are relatively narrow, elongated panels separated throughout the majority of their length by an interrupted cut line 11.

Each of the panels 10 and 12 is divided into contiguous aligned first, second and third panel sections 14*a*, 14*b*, and 14*c*, respectively, with panel sections 14*a* and 14*b* of each panel being joined to each other along aligned fold lines 15*a* and with panel sections 14*b* and 14*c* of panel being joined to each other along aligned fold lines 15*bc*.

Panel sections 14*a*, 14*b* and 14*c* of each panel have corresponding edge portions foldably joined to each other along fold lines 17*a*, 17*b* and 17*c*, respectively, which fold lines are in alignment with each other and with cut line 11.

Still referring to FIG. 1, it will be seen that fold lines 17*a*, 17*b* and 17*c* bisect gussets 18*a*, 18*b* and 18*c*, respectively, which are divided into pairs of gusset sections 19*a*, 19*b* and 19*c* by the fold lines 17*a*, 17*b* and 17*c*, respectively. The sections of each gusset are foldably joined to the panel sections 14*a*, 14*b* and 14*c* of which they are formed, by converging pairs of fold lines 21*a*, 21*b* and 21*c*, respectively.

To assist the folding of the panels into the configuration required as hereinafter described, there are provided cutouts 23*a* and 23*bc* at the junctures of the diagonal fold lines. Also, the remote ends of each pair of diagonal fold lines 21*a*, 21*b* and 21*c*, are connected by cut lines 27*a*, 27*b* and 27*c*, respectively, which extend normal to cut line 11.

Also, it will be noted that each of the panel sections of each panel is provided with a slot 25 which extends inwardly from the outer edge of the blank remote from cut line 11 in a direction normal thereto.

Figure 2:
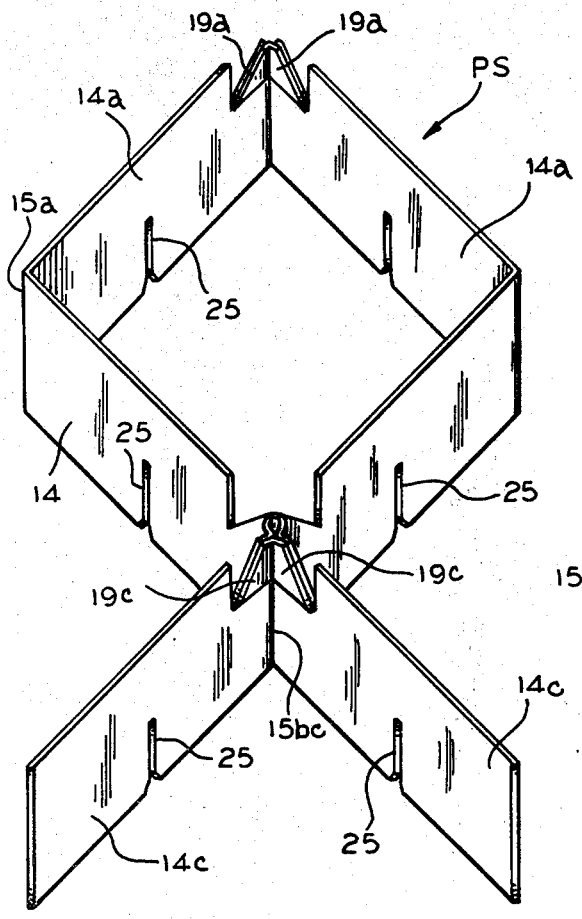
FIG. 2 is an isometric view showing the blank of FIG. 1 in erected shape.
Figure 3:
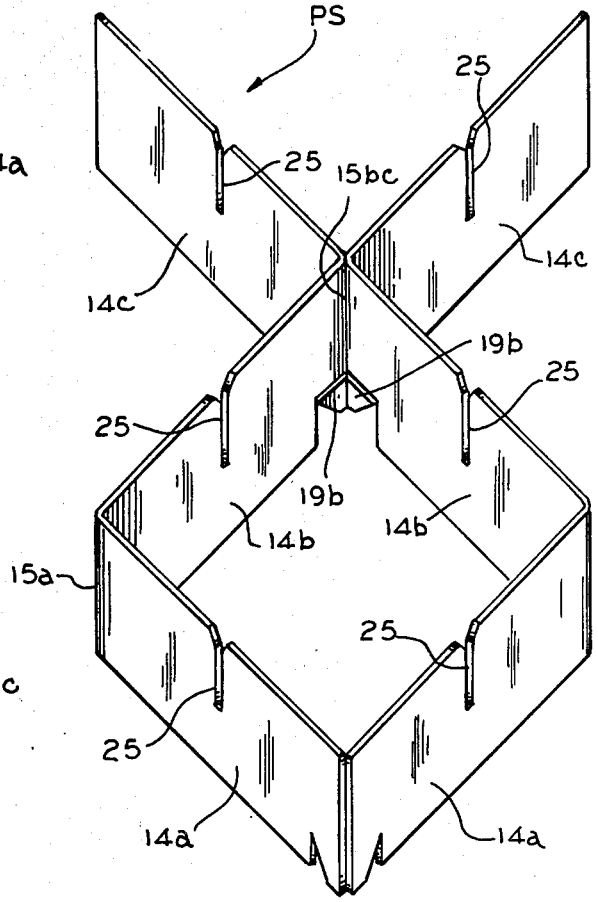
FIG. 3 is a view like FIG. 2, but showing a like erected blank in inverted position.

In forming the partition P, each of the partition sections PS are first erected to the position illustrated in FIGS. 2 and 3 and then placed together in interlocking relationship with the slots 25 of the panel sections of one partition section engaging the corresponding slots of the panel sections of the other partition section. Thus it will be seen that there is provided a plurality of diamond shaped cells by each of the panel sections which is greatly multiplied when the two panel sections are placed together in interlocking relationship, as shown in FIG. 4.

To form each panel section, the two panels of the section are first folded in face to face relation with the gusset sections of each gusset being folded in face to face relation. Then the panels are separated from each other to form the configurations illustrated in FIGS. 2 and 3.

Thus it will be appreciated that the invention provides a relatively inexpensive but novel partition structure which affords a great number of partition cells for an outer package.

We claim:

1. An internal partition structure formed from a pair of similar partition sections disposed in interlocking engagement with each other to provide a plurality of cells within an outer container or wrapper, comprising:

(a) a pair of similar partition sections, each being formed from a unitary blank of foldable paperboard or the like;

(b) each of said partition sections including a pair of similar, elongated panels separated throughout the majority of their lengths but joined to each other in at least two places;

(c) each of said panels being divided into at least two panel sections by at least one fold line extending transversely thereof;

(d) adjacent panel sections of each panel being folded at angles to each other and each being disposed parallel to a panel section of the other panel;

(e) each of the panel sections being foldably joined to a panel section of the other panel;

(f) said panel sections having slots extending inwardly from corresponding edges thereof for at least half the width thereof to permit the panels of each section to be joined with corresponding panels of a similar but inverted panel section to accommodate interlocking engagement therebetween.

2. A structure according to claim 1, including means for foldably joining each panel section to a corresponding panel section of the other panel comprising a gusset member having a pair of elements foldably joined to each other along a fold line bisecting said gusset member and foldably joined to respective panel sections along a pair of diverging fold lines, the remote ends of which are joined by a cut line.

* * * * *